US009746255B2

(12) United States Patent
Xia et al.

(10) Patent No.: US 9,746,255 B2
(45) Date of Patent: Aug. 29, 2017

(54) HEAT PUMP HEAT EXCHANGER HAVING A LOW PRESSURE DROP DISTRIBUTION TUBE

(71) Applicant: MAHLE International GmbH, Stuttgart (DE)

(72) Inventors: Yanping Xia, North Tonawanda, NY (US); Russell S. Johnson, Tonawanda, NY (US)

(73) Assignee: MAHLE International GmbH, Stuttgart (DE)

( * ) Notice: Subject to any disclaimer, the term of this patent is extended or adjusted under 35 U.S.C. 154(b) by 768 days.

(21) Appl. No.: 14/073,948

(22) Filed: Nov. 7, 2013

(65) Prior Publication Data

US 2015/0122470 A1 May 7, 2015

Related U.S. Application Data

(60) Provisional application No. 61/727,173, filed on Nov. 16, 2012.

(51) Int. Cl.
*F28F 9/22* (2006.01)
*F28F 9/02* (2006.01)

(52) U.S. Cl.
CPC ..... *F28F 9/0273* (2013.01)

(58) Field of Classification Search
CPC ..... F28F 9/0273
USPC ..... 165/174; 62/525
See application file for complete search history.

(56) References Cited

U.S. PATENT DOCUMENTS 7,331,195 B2 * 2/2008 Bae et al. ..... F25B 39/02 165/174
8,561,680 B2 * 10/2013 Jiang et al. ..... F28D 1/05366 165/174
2002/0046827 A1 * 4/2002 Saito et al. ..... F28D 1/0341 165/153
2003/0010483 A1 * 1/2003 Ikezaki et al. ..... F28F 3/083 165/174
2007/0039724 A1 * 2/2007 Trumbower et al. . F25B 39/028 165/174
2008/0093051 A1 * 4/2008 Rios et al. ..... F25B 41/067 165/61
2011/0017438 A1 * 1/2011 Huazhao et al. ..... F25B 39/028 165/174
2011/0127023 A1 * 6/2011 Taras et al. ..... F28F 9/0273 165/173

(Continued)

*Primary Examiner* — Allen Flanigan
(74) *Attorney, Agent, or Firm* — Brinks Gilson & Lione

(57) ABSTRACT

A heat pump heat exchanger includes a first manifold, a second manifold spaced from the first manifold, a plurality of refrigerant tubes hydraulically connecting the manifolds, and a distribution tube disposed in the first manifold. The distribution tube includes an inlet end, a distal end opposite the inlet end, a plurality of orifices between the inlet end and the distal end. The distribution tube also includes a terminal aperture immediately adjacent the distal end, wherein the terminal aperture includes an open aperture area greater than any one of the open orifice area. The open aperture area is large enough to provide a uniform refrigerant collection with acceptable minimal pressure drop in evaporative mode, but small enough to prevent vapor overflow to an area of the manifold adjacent to the distal end in condenser mode. The length of the distribution tube is less than ¾ the length of the first manifold.

15 Claims, 1 Drawing Sheet

(56) References Cited

U.S. PATENT DOCUMENTS

| | | | | |
|---|---|---|---|---|
| 2011/0203308 | A1* | 8/2011 | Chiang et al. | F28F 9/0273 62/498 |
| 2012/0292004 | A1* | 11/2012 | Chen et al. | F24J 2/245 165/175 |
| 2013/0192808 | A1* | 8/2013 | Liu | F25B 39/00 165/174 |

* cited by examiner

HEAT PUMP HEAT EXCHANGER HAVING A LOW PRESSURE DROP DISTRIBUTION TUBE

CROSS-REFERENCE TO RELATED APPLICATION

This application claims the benefit of U.S. Provisional Patent Application Ser. No. 61/727,173 for a HEAT EXCHANGER HAVING A LOW PRESSURE DROP OUTLET COLLECTOR, filed on Nov. 16, 2012, which is hereby incorporated by reference in its entirety.

TECHNICAL FIELD OF INVENTION

The present disclosure relates a heat pump heat exchanger; more particularly, to a heat pump heat exchanger having a distribution tube.

BACKGROUND OF INVENTION

Residential and commercial air conditioning and heat pump systems are known to employ modified automotive heat exchangers, which are desirable for its proven high heat transfer efficiency, durability, and relatively ease of manufacturability, as heat pump heat exchangers. A conventional automotive heat exchanger typically includes an inlet manifold, an outlet manifold, and a plurality of refrigerant tubes hydraulically connecting the manifolds for refrigerant flow therebetween. Corrugated fins interconnect adjacent refrigerant tubes to increase the available heat transfer area, as well as to increase the structural integrity of the heat exchanger. The core of the heat exchanger is defined by the refrigerant tubes and interconnecting corrugated fins.

Heat pump heat exchangers, also known as heat pump coils, are capable of operating as an evaporator and as a condenser. A heat pump system typically includes two heat pump heat exchangers, one located outdoors and the other indoors. When the heat pump system is in cooling mode, the indoor heat pump heat exchanger operates in evaporator mode and the outdoor heat pump heat exchanger operates in condenser mode. Inversely, when the heat pump system is in heating mode, the indoor heat pump heat exchanger operates in condenser mode and the outdoor heat pump coil operates in evaporator mode.

To meet the demands of residential and commercial applications, the size of the core of the heat pump heat exchanger has to be increased accordingly, which in turn dramatically increased the lengths of the inlet and outlet manifolds. For a heat pump heat exchanger operating in evaporator mode, the increased length of the manifolds tends to result in refrigerant mal-distribution through the refrigerant tubes. The effects of momentum and gravity, due to the large mass differences between the liquid and gas phases, can result in separation of the phases in the inlet manifold and cause poor refrigerant distribution through the refrigerant tubes. Poor refrigerant distribution degrades evaporator performance and can result in uneven temperature distribution over the core.

To assist in providing uniform refrigerant distribution through the refrigerant tubes, an inlet distributor having a plurality of uniformly spaced orifices is disposed within the inlet manifold for distributing the two-phase refrigerant throughout the length of the inlet manifold. Similarly, an outlet collector having a plurality of uniformly spaced orifices is disposed within the outlet manifold for collecting the vapor refrigerant throughout the length of the outlet manifold. Since refrigerant is in a vapor phase, its volume, vapor velocity, and the resulting pressure drop along the outlet manifold or outlet collector are much higher than if it remained in a liquid phase.

Outlet pressure drop in the outlet collector reduces performance by both constraining refrigerant flow, inducing refrigerant flow mal-distribution, and raising the core inlet pressure and temperature. Accordingly, there remains a need for a heat pump heat exchanger that has an improved outlet collector to provide for a reduced outlet pressure drop and more uniform refrigerant distribution throughout the core.

SUMMARY OF THE INVENTION

The invention relates to a heat pump heat exchanger having a first manifold, a second manifold spaced from the first manifold, a plurality of refrigerant tubes hydraulically connecting the manifolds, and a distribution tube disposed in the first manifold. The distribution tube includes an inlet end, a distal end opposite the inlet end, a plurality of orifices between the inlet end and the distal end. The distribution tube also includes a terminal aperture immediately adjacent the distal end, wherein the terminal aperture includes an open aperture area greater than any one of the open orifice area. The open aperture area is large enough to provide a uniform refrigerant collection with acceptable minimal pressure drop in evaporative mode, but small enough to prevent vapor overflow to an area of the manifold adjacent to the distal end in condenser mode. The length of the distribution tube is less than ¾ the length of the first manifold.

It is preferable that the ratio of the open area of the terminal aperture to the total open area of the other orifices is equal to the ratio of the manifold length minus tube length to the tube length as presented in the following equation:

$$[\text{Area}_{terminal\ aperture}/\text{Total Area}_{orifices}] = [[\text{length}_{manifold} - \text{length}_{tube}]/[\text{length}_{tube}]]$$

Where:

$\text{Area}_{terminal\ aperture}$=the open area of the terminal aperture;

$\text{Total Area}_{orifices}$=the sum of the open areas of the orifices;

$\text{length}_{manifold}$=the length of the manifold;

$\text{length}_{tube}$=the length of the improved distribution tube.

The improved distribution tube design provides similar refrigerant distribution as that of the full length distribution tube when functioning as an outlet collector, but improves evaporator performance by as much as 15% by reducing the outlet manifold pressure drop. The improved distribution tube has minimal, if any adverse effect when the heat pump heat exchanger operates in condenser mode, in which the improved distribution tube functions as an inlet distributor.

In the drawings as hereinafter described, a preferred embodiment is depicted; however, various other modifications and alternative designs and construction can be made thereto without departing from the spirit and scope of the invention.

BRIEF DESCRIPTION OF DRAWINGS

This invention will be further described with reference to the accompanying drawings in which.

DETAILED DESCRIPTION OF INVENTION

Figure 1:
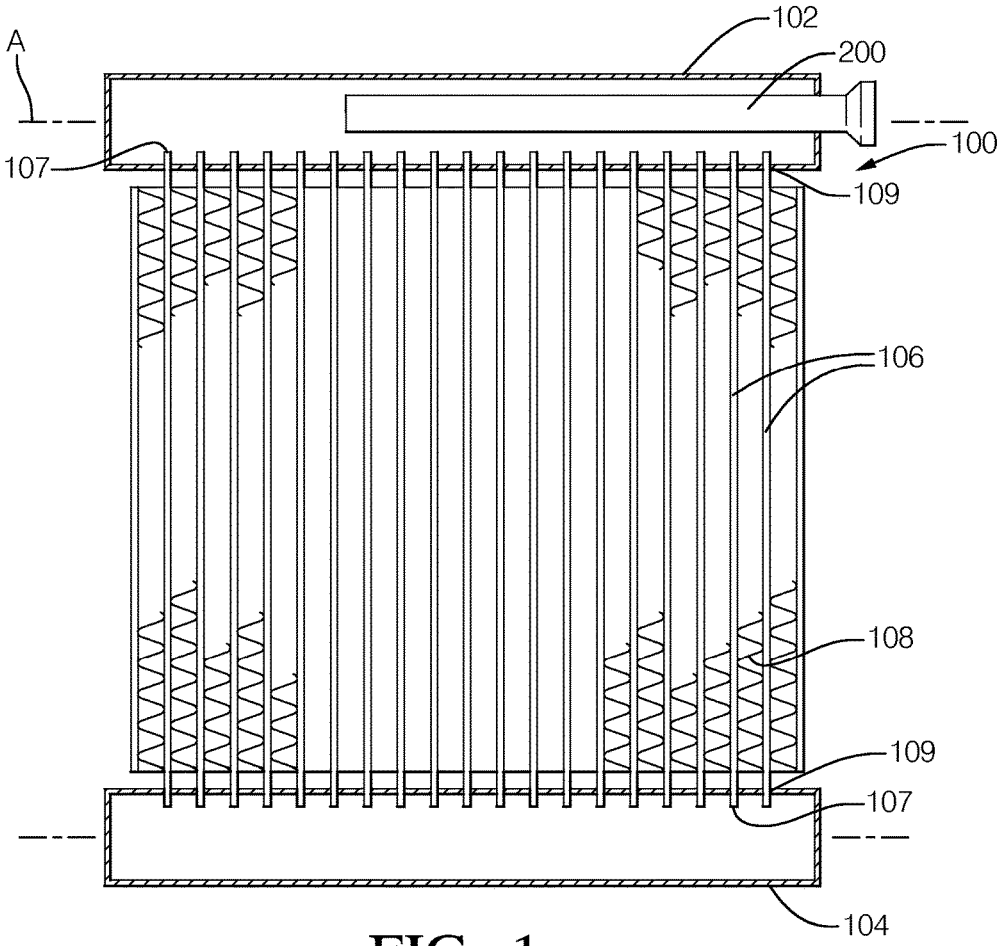
FIG. 1 shows a cross section of an embodiment of a heat pump heat exchanger having a distribution tube of the current invention.

Shown in FIG. 1 is the exemplary heat pump heat exchanger 100 of the current invention configured to operate as an evaporator and as a condenser depending on whether the heat pump system is in cooling or heating mode. Heat pump heat exchangers are also known as heat pump coils in the art. The heat exchanger assembly 100 includes a first manifold 102, a second manifold 104, and plurality of refrigerant tubes 106 hydraulically connecting the manifolds 102, 104. The refrigerant tubes 106 include opposite open ends 107 that are inserted through corresponding tube slots 109 positioned along the manifolds 102, 104 for refrigerant flow between the manifolds 102, 104. A plurality of fins 108 is disposed between adjacent refrigerant tubes 106 to facilitate heat exchange between the refrigerant flowing within the refrigerant tubes 106 and a stream of ambient air flowing pass the refrigerant tubes 106 and fins 108. The manifolds 102, 104, refrigerant tubes 106, and fins 108 are formed of a heat conductive material amendable to brazing, preferably an aluminum alloy. The components are assembled and then brazed into an integral heat pump heat exchanger 100.

The first manifold 102 is shown above the second manifold 104 respect to the direction of gravity; therefore, the first manifold 102 is also known as the upper manifold 102 and the second manifold 104 is known as the lower manifold 104. In evaporator mode, a two-phase refrigerant flows from the lower manifold 104 to the upper manifold 102 absorbing heat from a stream of ambient air flow as the refrigerant expands into a low pressure vapor refrigerant. In condenser mode, a high pressure vapor refrigerant flows from the upper manifold 102 to the lower manifold 104 while dispersing heat to the stream of ambient air flow as the vapor refrigerant condenses to a high pressure liquid refrigerant. In other words, the upper manifold 102 is the outlet manifold 102 when the heat pump heat exchanger 100 is in evaporator mode and an inlet manifold when the heat pump heat exchanger 100 is in condenser mode.

Due to higher heating and cooling load demands, residential and commercial heat exchangers require manifolds 102, 104 that are typically 3 to 8 times the length of a conventional automotive manifold. This dramatically increases the length of the manifolds 102, 104. Distribution tubes are known to be used in either or both of the manifolds 102, 104 in order to improve refrigerant distribution across the refrigerant tubes 106. A conventional distribution tube typically includes a cylindrical hollow tube having a plurality of orifices spaced along its length and extends substantially the full length of the manifolds 102, 104. Distribution tubes used in the inlet manifold are known as inlet distributors and distribution tubes used in the outlet manifolds are known as outlet collectors.

Inlet distributors are configured to deliver partially expanded a two phase refrigerant uniformly along the length of the inlet manifold. In practice their capacity is limited by the pressure drop created by the cross sectional area of the inlet distributor. Theoretically, the overall pressure drop generated by an inlet distributor does not affect evaporator performance, but in practice the pressure drop along the inlet manifold constrains performance by limiting refrigerant flow down the inlet manifold. Likewise outlet collectors are configured to collect expanded gaseous refrigerant uniformly along the length of the outlet manifold. Since the expanded refrigerant is primarily vapor at this point, due to the increase in volume, the velocity and the resulting pressure drop can be much higher. Increased outlet pressure drop reduces performance by constraining refrigerant flow, thereby inducing refrigerant flow mal-distribution across the refrigerant tubes, and raising the heat exchanger inlet pressure and temperature.

A conventional heat pump heat exchanger includes full length distribution tubes, approximately the same length of the manifolds, with distinct holes, also known as orifices. As mentioned above, when in evaporative mode, the upper manifold functions as an outlet manifold and the associated distribution tube functions as an outlet collector. It was surprisingly discovered that the conventional full length distribution tube disposed in the upper manifold may be replaced with an improved distribution tube 200 that runs only a portion of the length, approximately one-third to three-fourth, of the upper manifold. The improved distribution tube design provides similar refrigerant distribution as that of the full length distribution tube when functioning as an outlet collector, but improves evaporator performance by as much as 15% by reducing the outlet manifold pressure drop. It was also surprisingly found that the improved distribution tube 200 has minimal, if any adverse effect when the heat pump heat exchanger 100 operates in condenser mode, in which the improved distribution tube 200 functions as an inlet distributor.

Figure 2:
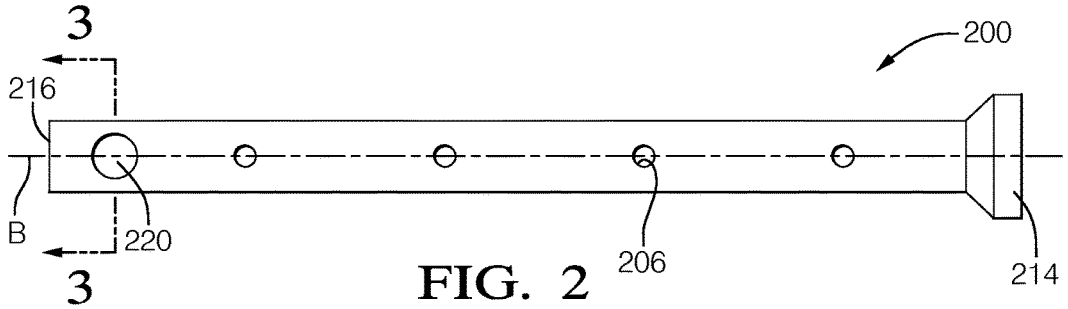
FIG. 2 shows an embodiment of a distribution tube of the current invention.

Shown in FIG. 2 is a bottom view of an embodiment of the improved distribution tube 200 for a heat pump heat exchanger 100 that functions as both an outlet collector when the heat exchanger is operating in evaporator mode and as an inlet distributor when the heat exchanger is operating in condenser mode. The distribution tube 200 includes an inlet end 214, a blind distal end 216 opposite that of the inlet end 214, and a plurality of orifices 206 therebetween. The plurality of orifices 206 may be arranged in a linear array along the length of the distribution tube 200 and oriented toward the refrigerant tubes 106. The distribution tube also includes a terminal aperture 220 immediately adjacent the blind distal end 216. The terminal aperture 220 may also be defined by a non-blinded distal end 216 in which the terminal aperture 220 is oriented perpendicular to the direction of gravity. The length of the distribution tube 200 is shown extending along an axis B that is substantially parallel with the axis A of the manifold. The length of the distribution tube 200 may be less than ¾ of the length of the outlet manifold.

The size of the open area of the terminal aperture 220 is large enough to provide a uniform refrigerant collection throughout the manifold with acceptable minimal pressure drop in evaporative mode, but small enough to prevent vapor overflow to the area of the manifold adjacent the distribution tube 200 distal end 216 in condenser mode.

It is preferable that the ratio of the open area of the terminal aperture 220 to the total open area of the other orifices 206 is equal to the ratio of the manifold length minus tube length to the tube length as presented in the following equation:

$$[\text{Area}_{terminal\ aperture}/\text{Total Area}_{orifices}] = [[\text{length}_{manifold} - \text{length}_{tube}]/[\text{length}_{tube}]]$$

Where:

$\text{Area}_{terminal\ aperture}$=the open area of the terminal aperture 220;

Total $\text{Area}_{orifices}$=the sum of the open areas of the orifices 206;

$\text{length}_{manifold}$=the length of the manifold 102;

$\text{length}_{tube}$=the length of the improved distribution tube 200.

Figure 3:
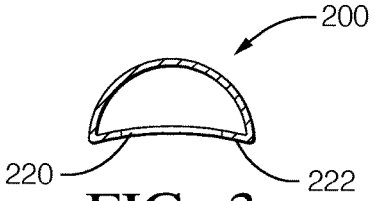
FIG. 3 shows a cross section of the distribution tube of FIG. 2 along lines 3-3.

Shown in FIG. 3 is the cross section of the distribution tube 200 in which the bottom portion 222 of the distribution tube 200 is bowed inward to define a crescent moon shaped cross-section. The improved distribution tube 200 provides a means to improve refrigerant distribution, heat transfer performance, and outlet air temperature distribution in heat exchangers used as both an evaporator and a condenser in heat pump applications. This improvement provides a distribution tube 200 design that evenly distributes refrigerant in both evaporator and condenser mode, improves evaporator mode performance by reducing refrigerant pressure drop, and reduces material cost.

While this invention has been described in terms of the preferred embodiments thereof, it is not intended to be so limited, but rather only to the extent set forth in the claims that follow.

Having described the invention, it is claimed:

1. A heat pump heat exchanger comprising:

a first manifold;

a second manifold spaced from the first manifold;

a plurality of refrigerant tubes hydraulically connecting the first manifold to the second manifold; and a distribution tube disposed in the first manifold, wherein the distribution tube includes an inlet end, a distal end opposite the inlet end, a plurality of orifices between the inlet end and the distal end, and a terminal aperture between the distal end and the plurality of orifices;

wherein the distribution tube includes a length less than length of the first manifold;

wherein each of the plurality of orifices includes an open orifice area; and wherein the terminal aperture includes an open aperture area greater than the sum of the-open orifice-areas of all orifices between the inlet end and the terminal aperture.

2. The heat pump heat exchanger of claim 1, having a ratio of the open aperture area to the sum of the open orifice areas is equal to the ratio of the manifold length minus distribution tube length to the distribution tube length as presented in the following equation:

$$[\text{Area}_{terminal\ aperture}/\text{Total Area}_{orifices}]=[[\text{length}_{manifold}-\text{length}_{tube}]/[\text{length}_{tube}]]$$

Where:

Area terminal $_{aperture}$=the open aperture area;

Total Area$_{orifices}$=the sum of the open orifice areas;

length$_{manifold}$=the length of manifold;

length$_{tube}$=the length of distribution tube.

3. The heat pump heat exchanger of claim 1, wherein the length of the distribution tube is less than ¾ of the length of the first manifold.

4. The heat pump heat exchanger of claim 1, wherein, when the heat exchanger is in an operating position, in which the first manifold is an upper manifold and the second manifold is a lower manifold, with respect to the direction of gravity, the heat exchanger is selectively operable as an evaporator and as a condenser.

5. The heat pump heat exchanger of claim 1, wherein the plurality of the orifices is oriented in the direction of the plurality of refrigerant tubes.

6. The heat pump heat exchanger of claim 5, wherein the terminal aperture is oriented in the direction of the plurality of refrigerant tubes.

7. A heat pump heat exchanger comprising:

a first manifold having a manifold length;

a second manifold spaced from the first manifold;

a plurality of refrigerant tubes hydraulically connecting the first manifold to the second manifold; and a distribution tube disposed in the first manifold, wherein the distribution tube includes an inlet end, a distal end opposite the inlet end, several orifices between the inlet end and the distal end, and a terminal aperture immediately adjacent the distal end;

wherein the distribution tube includes a distribution tube length less than the manifold length;

wherein each of the several orifices includes an open orifice area; and wherein the terminal aperture includes an open aperture area; and wherein ratio of the open aperture area to the sum of the open orifice areas of all orifices between the inlet end and the terminal aperture is equal to the ratio of the manifold length minus distribution tube length to the distribution tube length as presented in the following equation:

$$[\text{Area}_{terminal\ aperture}/\text{Total Area}_{orifices}]=[[\text{length}_{manifold}-\text{length}_{tube}]/[\text{length}_{tube}]]$$

Where:

Area$_{terminal\ aperture}$=the open aperture area;

Total Area$_{orifices}$=the sum of the open orifice areas;

length$_{manifold}$=the length of manifold;

length$_{tube}$=the length of distribution tube.

8. The heat pump heat exchanger of claim 7, wherein the length of the distribution tube is less than ¾ of the length of the first manifold.

9. The heat pump heat exchanger of claim 7, wherein, when the heat exchanger is in an operating position, in which the first manifold is an upper manifold and the second manifold is a lower manifold, with respect to the direction of gravity, the heat exchanger is selectively operable as an evaporator and as a condenser.

10. The heat pump heat exchanger of claim 9, wherein the plurality of the orifices is oriented in the direction of the plurality of refrigerant tubes.

11. The heat pump heat exchanger of claim 10, wherein the terminal aperture is oriented in the direction of the plurality of refrigerant tubes.

12. A heat pump heat exchanger comprising:

a first manifold;

a second manifold spaced from the first manifold;

a plurality of refrigerant tubes hydraulically connecting the first manifold to the second manifold; and a distribution tube disposed in the first manifold, wherein the distribution tube includes an inlet end, a distal end opposite the inlet end, and at least one orifice between the inlet end and the distal end, each of the at least one orifice having an open orifice area;

wherein the distribution tube includes a length less than length of the first manifold; and wherein a terminal aperture is arranged between the distal end and the at least one orifice, the terminal aperture having an open aperture area larger than the open orifice area of each of the at least one orifice, wherein the distribution tube is bowed inward at the terminal aperture.

13. The heat pump heat exchanger of claim 12, wherein the length of the distribution tube is less than ¾ of the length of the first manifold.

14. The heat pump heat exchanger of claim 12, wherein, when the heat exchanger is in an operating position, in which the first manifold is an upper manifold and the second manifold is a lower manifold, with respect to the direction of gravity, the heat exchanger is selectively operable as an evaporator and as a condenser.

15. The heat pump heat exchanger of claim 12, wherein in the operating position, the terminal aperture is oriented in the direction of gravity.

* * * * *